US008223092B2

(12) United States Patent
Lee

(10) Patent No.: US 8,223,092 B2
(45) Date of Patent: Jul. 17, 2012

(54) PLASMA DISPLAY PANEL AND METHOD OF DRIVING THE SAME

(75) Inventor: Sang-Gu Lee, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 890 days.

(21) Appl. No.: 12/236,415

(22) Filed: Sep. 23, 2008

(65) Prior Publication Data

US 2009/0085837 A1 Apr. 2, 2009

(30) Foreign Application Priority Data

Sep. 28, 2007 (KR) ..... 10-2007-0098283

(51) Int. Cl.
*G09G 3/28* (2006.01)

(52) U.S. Cl. ..... 345/68; 345/60; 345/67; 315/167; 315/169.1; 315/169.4

(58) Field of Classification Search ..... 345/60, 345/67, 68, 69, 204, 211, 212, 213, 214, 345/215, 690, 691; 315/167, 169.1, 169.4
See application file for complete search history.

(56) References Cited

U.S. PATENT DOCUMENTS

| | | | | |
|---|---|---|---|---|
| 3,840,779 | A * | 10/1974 | Schermerhorn | 345/68 |
| 6,452,590 | B1 * | 9/2002 | Awamoto et al. | 345/211 |
| 7,528,801 | B2 * | 5/2009 | Ito et al. | 345/60 |
| 2002/0142694 | A1 * | 10/2002 | Lai et al. | 445/1 |
| 2005/0225510 | A1 * | 10/2005 | Ito et al. | 345/60 |

FOREIGN PATENT DOCUMENTS

| | | | |
|---|---|---|---|
| JP | 2005-196131 | | 7/2005 |
| KR | 2003-0071188 | A | 9/2003 |
| KR | 10-2004-0105919 | | 12/2004 |
| KR | 10-2005-0028528 | | 3/2005 |
| KR | 10-2005-0051859 | | 6/2005 |
| KR | 10-2006-0053532 | | 5/2006 |
| KR | 10-2006-0067887 | A | 6/2006 |
| KR | 10-2006-0130435 | A | 12/2006 |
| KR | 10-2007-0075480 | A | 7/2007 |

OTHER PUBLICATIONS

Notice of Allowance issued by the KIPO on Dec. 29, 2008 indicating cited references.

* cited by examiner

*Primary Examiner* — My-Chau T Tran
(74) *Attorney, Agent, or Firm* — Christie, Parker & Hale, LLP

(57) ABSTRACT

A plasma display device driven during an address period and a sustain period includes a discharge cell defined by a scan electrode, a sustain electrode, and an address electrode, an addressing circuit for providing an address voltage to the address electrode, and an addressing compensation circuit for storing voltage corresponding to a displacement current generated during a sustain period to be utilized during the address period. The addressing compensation circuit includes a switch coupled with the address electrode through which the displacement current supplied from the scan electrode and the sustain electrode is received during the sustain period, and a capacitor coupled with the switch for storing the voltage corresponding to the displacement current received through the switch.

7 Claims, 6 Drawing Sheets

RELATED ART

RELATED ART

PLASMA DISPLAY PANEL AND METHOD OF DRIVING THE SAME

CROSS-REFERENCE TO RELATED APPLICATIONS

This application claims priority to and the benefit of Korean Patent Application No. 10-2007-0098283, filed on Sep. 28, 2007, in the Korean Intellectual Property Office, the entire content of which is incorporated herein by reference.

BACKGROUND

1. Field of the Invention

The present invention relates to a plasma display panel (PDP) and a method of driving the same.

2. Description of the Related Art

A plasma display panel (PDP) emits light from a phosphor using ultraviolet (UV) rays generated during the discharge of an inert mixed gas to display an image. The PDP can be made thin and large and provides significantly improved picture quality due to recent technology development. In particular, in a three-electrode alternating current (AC) surface discharge type PDP, since wall charges are accumulated on the surface during the discharge and electrodes are protected against the sputtering generated by the discharge, the three-electrode AC surface discharge type PDP is driven at a relatively low voltage and has a long life.

However, when the above-described PDP is driven, an address output in a state of 0 (low) is applied in a sustain period. In this case, displacement current that flows from a scan electrode (Y) and a sustain electrode (X) to an address electrode affects the heat generation of a tape carrier package (TCP). Alternatively, if address data in a state of 1 (high) is applied in the sustain period, the TCP may be damaged due to the displacement current in the sustain period or current may be introduced to the address voltage supply end of a switched mode power supply (SMPS) such that the SMPS is damaged.

SUMMARY OF THE INVENTION

In exemplary embodiments of the present invention, a plasma display panel (PDP) and a method of driving the same is provided. According to embodiments of the present invention, the PDP is prevented from being burned out because of increases in power consumption of an SMPS and the heat generation of a TCP.

In an exemplary embodiment of the present disclosure, there is provided a plasma display device driven during an address period and a sustain period, wherein the plasma display device includes a discharge cell defined by a scan electrode, a sustain electrode, and an address electrode, an addressing circuit for providing an address voltage to the address electrode, and an addressing compensation circuit for storing voltage corresponding to a displacement current generated in the sustain period to be utilized during the address period, the addressing compensation circuit including a switch coupled with the address electrode through which the displacement current generated at the discharge cell during the sustain period is received, and a capacitor coupled with the switch for storing a voltage corresponding to the displacement current received through the switch.

The addressing compensation circuit may further include a Zener diode coupled to the switch and the capacitor.

The Zener diode may be coupled with the capacitor in parallel.

The addressing circuit may further include a first voltage switch for supplying the address voltage to the address electrode, and a second voltage switch for supplying a voltage lower than the address voltage to the address electrode.

The address electrode may form a second capacitor together with the scan electrode or the sustain electrode to store voltage received from the addressing circuit.

In another exemplary embodiment of the present disclosure, there is provided a method of driving a PDP in accordance with a driving waveform during a reset period, an address period, and a sustain period, wherein the method includes storing a voltage corresponding to a displacement current generated during a sustain period in a capacitor, and utilizing the voltage corresponding to the displacement current to provide an address voltage during an address period.

The stored voltage corresponding to the displacement current may be clamped to be no greater than the address voltage.

The method may further include storing the address voltage in a discharge capacitor in accordance with the driving waveform.

The method may further include storing a voltage lower than the address voltage in a discharge capacitor in accordance with the driving waveform.

In another exemplary embodiment of the present disclosure, there is provided a plasma display device driven during an address period and a sustain period, wherein the plasma display device includes a discharge cell formed by a scan electrode, a sustain electrode and an address electrode, an addressing circuit comprising a first switch coupled with a first voltage source for supplying the address voltage to the address electrode and a second switch coupled with a second voltage source for supplying a voltage lower than the address voltage to the address electrode, and an addressing compensation circuit comprising a third switch coupled with the address electrode through which a displacement current generated at the discharge cell during the sustain period is received, and a capacitor coupled with the third switch for storing a voltage corresponding to the displacement current received through the switch, the addressing compensation circuit configured to store the voltage corresponding to the displacement current generated in the sustain period to be utilized during the address period.

The addressing compensation circuit may further include a Zener diode coupled to the third switch and the capacitor.

The Zener diode may be coupled with the capacitor in parallel.

In another exemplary embodiment of the present disclosure, there is provided a method of driving a PDP in accordance with a driving waveform during a reset period, an address period and a sustain period, the method comprising storing address voltage in a first capacitor in accordance with the driving waveform, driving the PDP utilizing the address voltage stored in the first capacitor, thereby generating a displacement current, turning on a switch to allow the displacement current to flow to a second capacitor, storing voltage corresponding to the displacement current in the second capacitor, resetting the PDP during the reset period, and applying the voltage corresponding to the displacement current to the first capacitor in accordance with the driving waveform.

The stored voltage corresponding to the displacement current may be clamped to be no greater than the address voltage.

The voltage stored in the second capacitor has a voltage level that is lower than the address voltage.

BRIEF DESCRIPTION OF THE DRAWINGS

These and/or other embodiments and features of the invention will become apparent and more readily appreciated from the following description of certain exemplary embodiments, taken in conjunction with the accompanying drawings of which.

DETAILED DESCRIPTION

Figure 1:
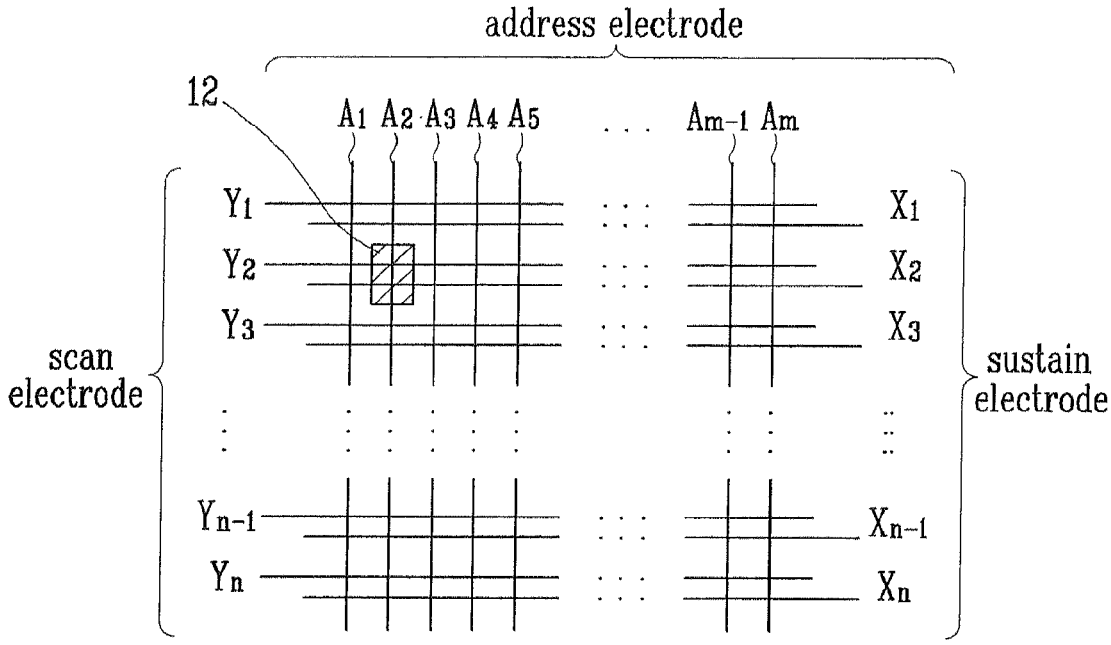
FIG. 1 illustrates the arrangement of electrodes in a conventional plasma display panel (PDP)

Hereinafter, certain exemplary embodiments according to the present invention will be described with reference to the accompanying drawings. Here, when a first element is described as being coupled to a second element, the first element may be directly coupled to the second element, or alternatively, may be indirectly coupled to the second element via a third element. Further, some of the elements that are not essential to the complete understanding of the invention are omitted for clarity. Also, like reference numerals refer to like elements throughout.

FIG. 1 illustrates the arrangement of electrodes in a conventional plasma display panel (PDP).

Referring to FIG. 1, the PDP includes a plurality of address electrodes A1, A2, . . . , and Am extending in a column direction, a plurality of scan electrodes Y1, Y2, . . . , and Yn extending in a row direction, and sustain electrodes X1, X2, . . . , and Xn substantially parallel to the plurality of scan electrodes.

The AC type PDP is time division driven such that one frame is divided into a plurality of subfields, and each of the subfields is driven during a reset period, an address period, and a sustain period.

In the reset period, each of the pixels 12 is initialized so that the addressing operation of the pixels 12 can be performed properly. In the address period, an address voltage is applied to a selected pixel 12 to accumulate wall charges in order to selectively turn on the pixel 12 in the PDP. In the sustain period, sustain pulses are applied to perform discharges in the addressed pixels 12 to display an image. To perform the sustain discharge operation with the AC type PDP, a high voltage of several hundreds of volts is required. Therefore, to reduce or minimize the voltage required for the sustain discharge, conventional PDPs utilize an energy recovery circuit. The energy recovery circuit recovers a voltage between the scan electrodes Y1, Y2, . . . , and Yn and the sustain electrodes X1, X2, . . . , and Xn for use as a driving voltage during a next discharge.

Figure 2:
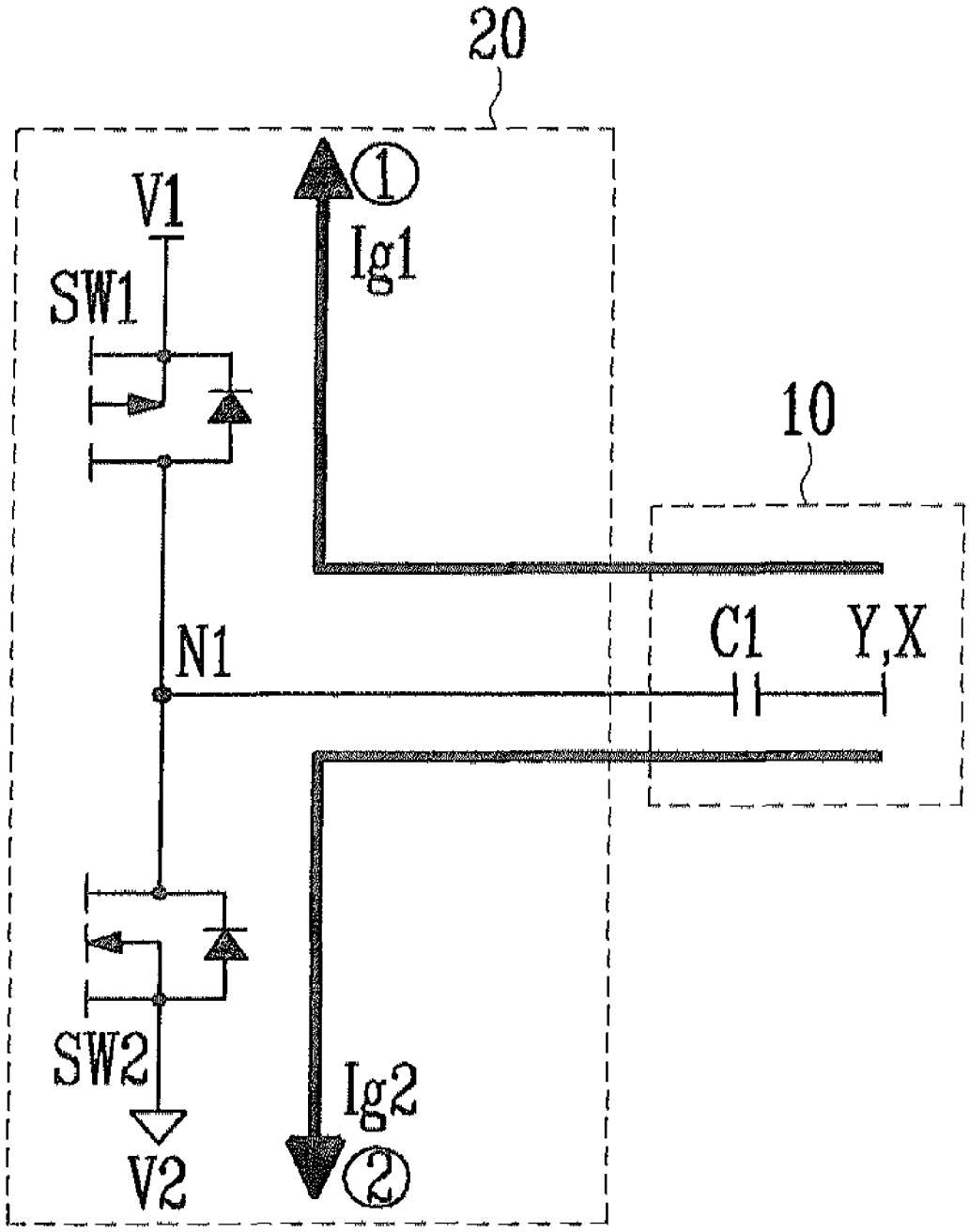
FIG. 2 is a simplified circuit diagram illustrating a conventional plasma display device including the PDP of FIG. 1.

FIG. 2 is a simplified circuit diagram illustrating the conventional plasma display device including the PDP of FIG. 1.

Referring to FIG. 2, the conventional plasma display device includes a discharge cell 10 and an addressing circuit 20.

For convenience of explanation, the illustration and description of the energy recovery circuit are omitted. The energy recovery circuit may be formed in each of a scan electrode driver and a sustain electrode driver coupled with the scan electrode Y and the sustain electrode X, respectively, to alternately supply the sustain pulse to a capacitor C1.

The discharge cell 10 includes the capacitor C1 and repeatedly charges and discharges the capacitor C1 by a predetermined voltage to display an image.

The addressing circuit 20 provides an address signal for selecting a specific cell during the address period.

Here, a first switch SW1 is coupled between a first voltage source and a first node N1 to selectively transmit a first voltage V1 to the discharge cell 10 in the address period. The addressing circuit 20 provides the address signal to the terminal of the capacitor C1 coupled to the node N1 that includes an address electrode A.

A second switch SW2 is coupled between the first node N1 and a second voltage source to selectively transmit a second voltage V2 of a level lower than the level of the first voltage V1 to the discharge cell 10.

In the above-described plasma display device, at the moment when the first switch SW1 is turned on, displacement current Ig1 from the sustain electrode X and the scan electrode Y flows backward along a first path ①. A power source supply unit (SMPS) (not shown) coupled with the first voltage source V1 may be damaged by the displacement current Ig1.

When the second switch SW2 is turned on, displacement current Ig2 from the sustain electrode X and the scan electrode Y flows along a second path ②, which may cause a tape carrier package (TCP) (not shown) to generate heat, thereby affecting the performance of the PDP and/or causing damage to the PDP.

Figure 3:
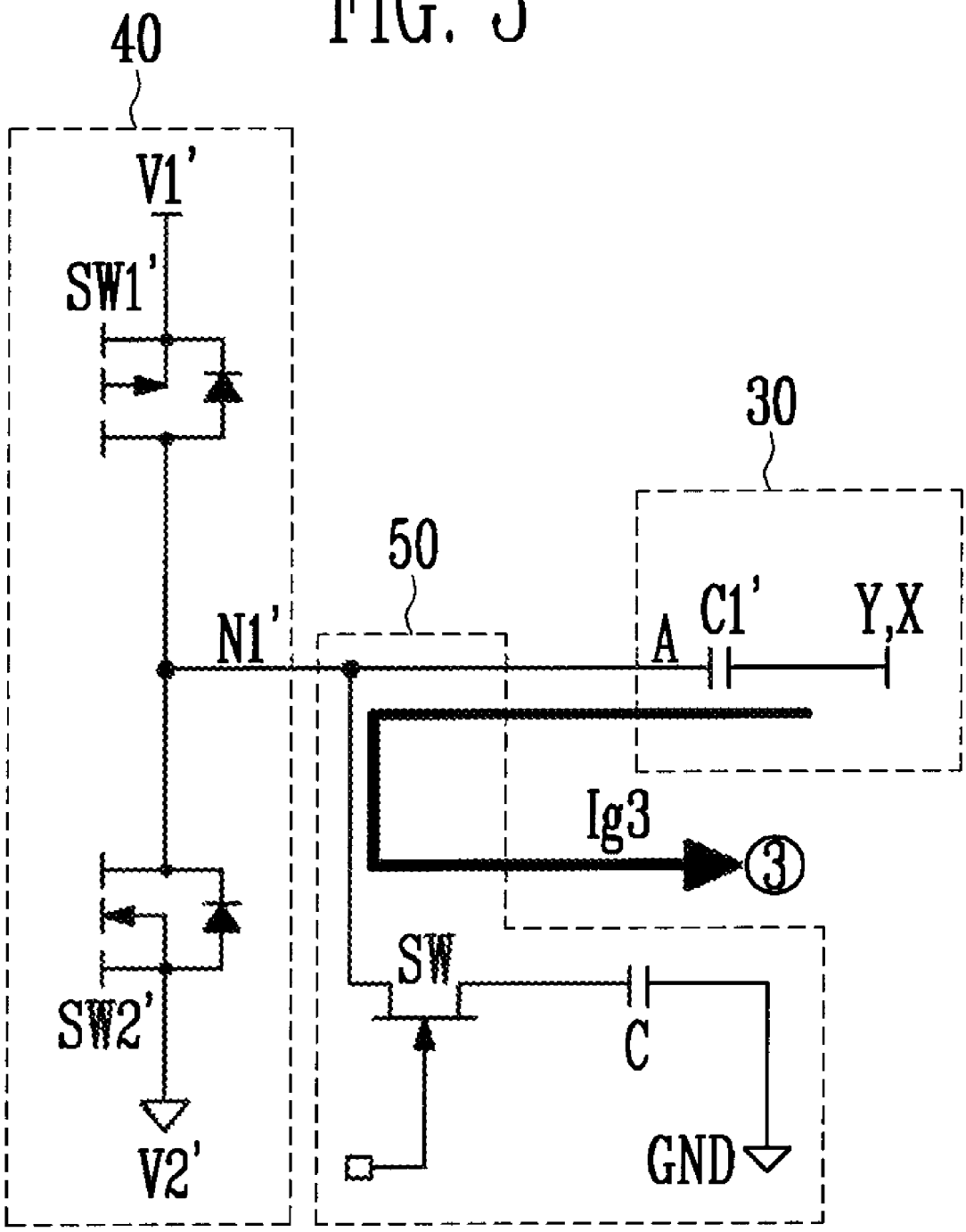
FIG. 3 is a simplified circuit diagram illustrating a plasma display device according to an embodiment of the present invention.

FIG. 3 is a simplified circuit diagram illustrating a plasma display device according to an embodiment of the present invention. The plasma display device of FIG. 3 may include the PDP of FIG. 1 or any other PDP having a suitable structure.

For convenience of explanation, the illustration and description of the energy recovery circuit are omitted. The energy recovery circuit may be formed in each of the scan electrode driver and the sustain electrode driver coupled with a scan electrode Y and a sustain electrode X and the scan electrode Y and the sustain electrode X, respectively, to alternately supply the sustain pulse to a capacitor C1'. As shown in FIG. 3, the first capacitor C1' is formed between the scan and/or sustain electrodes Y, X and the address electrode A.

Figure 5:
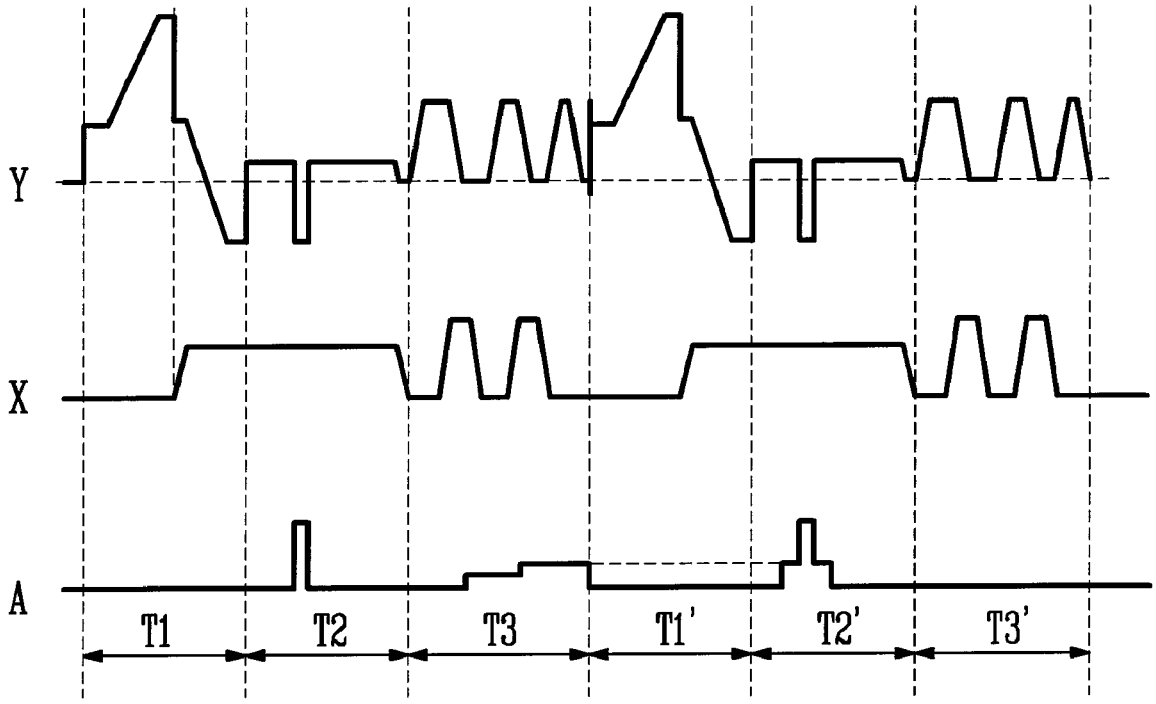
FIG. 5 illustrates a simulation of the plasma display device of FIG. 3.
Figure 6:
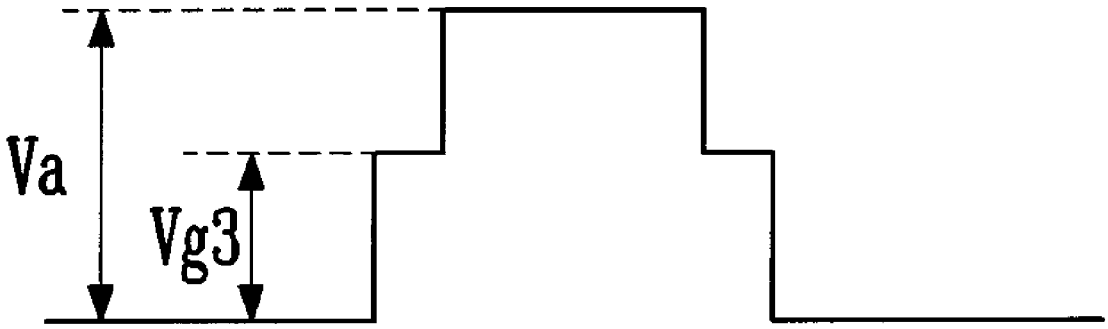
FIG. 6 illustrates a driving waveform of an address voltage of a plasma display device according to an embodiment of the present invention.

FIG. 5 illustrates a simulation in accordance with FIG. 3. FIG. 6 illustrates the driving waveform of an address voltage according to an embodiment of the present invention.

Referring to FIG. 3, the plasma display device according to an embodiment of the present invention includes a discharge cell 30, an addressing circuit 40, and an addressing compensation circuit 50 for storing voltage corresponding to displacement current generated during the sustain period for use during a next address period (i.e., during next addressing). While only one addressing circuit 40 is shown in FIG. 3, the plasma display device includes a plurality of addressing circuits 40, each coupled to one of a plurality of address electrodes A.

The discharge cell 30 includes a capacitor C1'. The discharge cell repeatedly charges and discharges the capacitor C1' (e.g., by a predetermined voltage) to display an image.

In the present embodiment, the capacitor C1' is coupled between the sustain electrode X and/or the scan electrode Y, and the address electrode A.

As illustrated in FIG. 3, a first switch SW1' of the addressing circuit 40 is coupled between a first voltage source and a node N1' to selectively transmit a first voltage V1' from the first voltage source to the discharge cell 30 during the sustain period and the address period.

A second switch SW2' is coupled between the node N1' and a second voltage source to selectively transmit the second voltage V2' from the second voltage source of a level lower than the level of the first voltage V1' to the discharge cell 30.

In addition, the addressing compensation circuit 50 includes a switch SW (e.g., a third switch) and a capacitor C to store the displacement current generated in the sustain period and to use the stored displacement current (i.e., stored voltage corresponding to the displacement current) during the next address period (i.e., during next addressing).

As described in FIG. 3, the switch SW included in the addressing compensation circuit 50 is coupled between the node N1' and a ground voltage source GND and is coupled to the capacitor C1' of the discharge cell 30 in parallel.

In addition, the capacitor C is serially coupled between the node N1' and the ground voltage source GND.

Referring to FIGS. 3 and 5, the operation of the plasma display device according to the embodiment of the present invention having the above-described structure will be described as follows.

The operation of the plasma display device is performed using waveforms during reset periods T1 and T1', address periods T2 and T2', and sustain periods T3 and T3'.

In the reset periods T1 and T1', wall charges formed by previous sustain discharge are erased and the wall charges are set up in order to stably perform next address discharge.

In the address periods T2 and T2', the cells that are turned on and the cells that are not turned on are selected from the PDP so that the wall charges are accumulated on the cells (addressed cells) that are turned on.

In the sustain periods T3 and T3', sustain discharge is performed on the addressed cells to display an image.

In performing the above-described operation, in the PDP according to the embodiment of the present invention, if an address output in a state of 0 (low) is applied during the sustain period, displacement current that flows from the scan electrode (Y) and the sustain electrode (X) to the address electrode (A) affects the heat generation of the TCP. In addition, if address data in a state of 1 (high) is applied during the sustain period, the TCP may be damaged due to the displacement current in the sustain period or current is introduced to the address voltage supply end of a switched mode power supply (SMPS) so that the SMPS is damaged. To avoid these problems, the displacement current generated in the sustain period is stored through the addressing compensation circuit 50 coupled with the addressing circuit 40 to use the stored displacement current (i.e., stored voltage corresponding to the displacement current) during a next address period (i.e., during next addressing).

That is, when the switch SW in the addressing compensation circuit 50 is turned on, a current path is formed through the capacitor C1' of the discharge cell 30 and the switch SW and the capacitor C of the addressing compensation circuit 50. Displacement current Ig3 introduced from the sustain electrode X' and the scan electrode Y', passing through the capacitor C1', and generated in the sustain period, flows along a third path ③.

Therefore, a voltage Vg3 corresponding to the displacement current Ig3 is charged in the capacitor C in the addressing compensation circuit 50.

When a continuously changing voltage is applied to the charged capacitor C1', rather than a direct current, charges continuously flow from or to a power source in order to sustain the voltage.

At this time, the greater the capacity of the capacitor C1', the more charges move. There are no charges that cross polar plates (e.g., electrodes) of the capacitor C1'. However, due to the movement of the charges pushed into and pushed out of the polar plates of the capacitor C1', current actually flows outside the capacitor C1'. Such current is referred to as displacement current.

According to the present embodiment of the present invention, the voltage corresponding to the displacement current Ig3 stored in the capacitor C in an Nth sustain period T3 is used in an (N+1)th address period T2'. That is, the switch SW is turned off and the second switch SW2' is turned on in an (N+1)th reset period T1' to initialize the capacitor C1'. Next, in the address period T2', the switch SW is turned on to transmit the voltage corresponding to the displacement current Ig3 stored in the capacitor C before an address voltage Va is supplied to the capacitor C1'. Finally, the first switch SW1' is turned on to charge the address voltage Va in the capacitor C1'. Since the voltage corresponding to the displacement current Ig3 has been previously charged in the capacitor C1', it is possible to reduce power consumption associated with increasing a voltage to the address voltage Va. Here, the first voltage V1' may correspond to the address voltage Va.

FIG. 6 illustrates a driving waveform of an address voltage of a plasma display device according to an exemplary embodiment of the present invention. In conventional technology, since it is necessary to increase a voltage from 0V to the address voltage Va in charging the address voltage in the capacitor C1', a large amount of power is consumed. Referring to FIG. 6, however, the voltage corresponding to the displacement current Ig3 is previously stored in the Nth sustain period T3. Therefore, in the (N+1)th address period T2', only the difference between the address voltage Va and the voltage Vg3 corresponding to the displacement current Ig3 is supplied by the SMPS.

Figure 4:
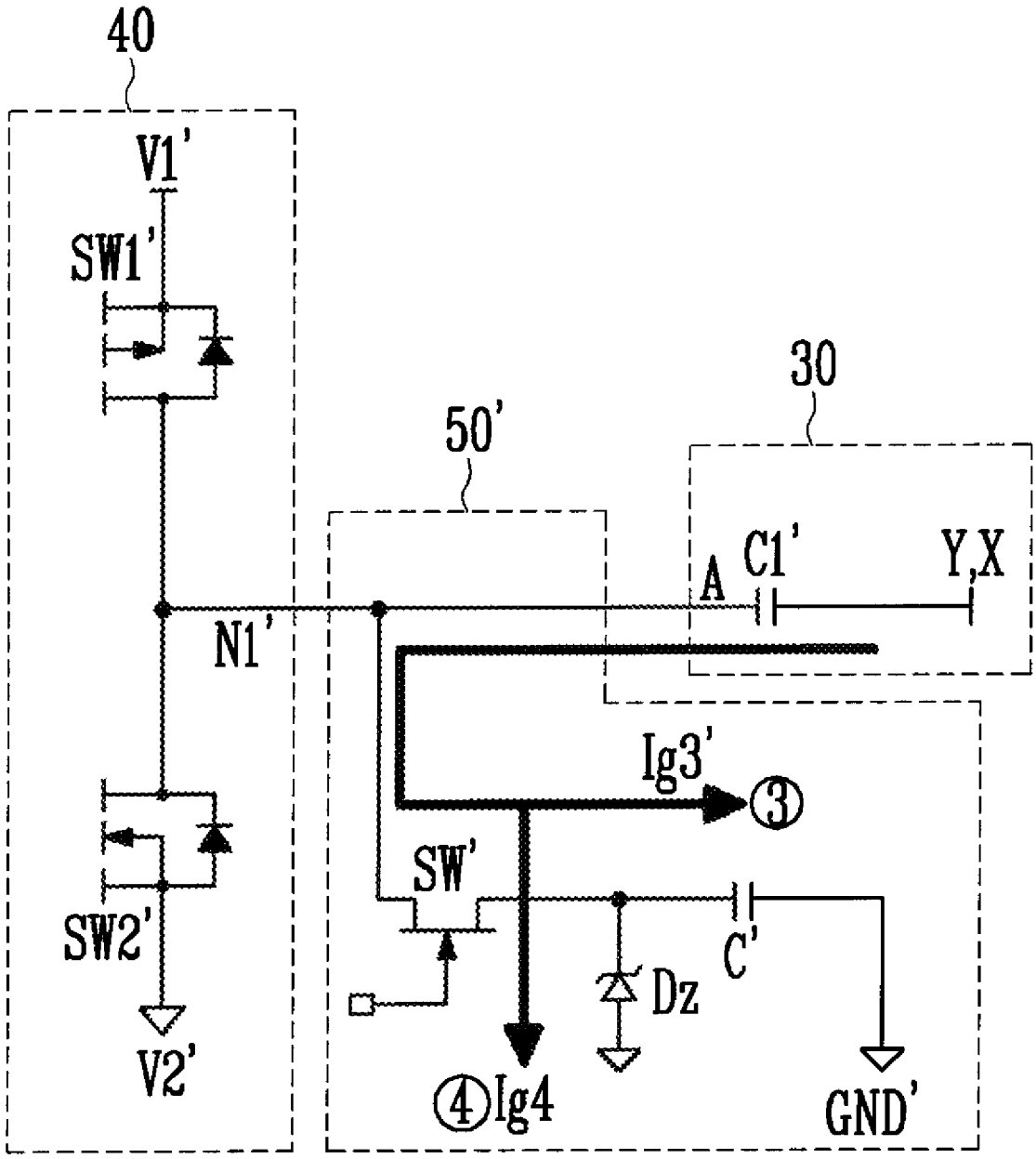
FIG. 4 is a simplified circuit diagram illustrating a plasma display device according to another embodiment of the present invention.

FIG. 4 is a circuit diagram illustrating a plasma display device according to another embodiment of the present invention.

Comparing FIG. 4 with FIG. 3, a Zener diode Dz is additionally provided in an addressing compensation circuit 50' in the embodiment of FIG. 4. The plasma display device of FIG. 4 further includes the discharge cell 30 formed by a sustain electrode Y and a scan electrode X coupled to one terminal of a capacitor C1'. The other terminal of the capacitor C1' is coupled to node N1' and includes an address electrode A. The plasma display device also includes the addressing circuit 40 including a first voltage source having a first voltage V1' (e.g., an address voltage Va), a first switch SW1' coupled between the first voltage source and the node N1', a second voltage source having a second voltage V2', and a second switch SW2' coupled between the second voltage source and the node N1'. The first and second switches SW1' and SW2' are coupled to each other at node N1'.

Since the elements in the embodiment of FIG. 4, excluding the Zener diode Dz, are substantially the same and have substantially the same functions as the elements in the embodiment of FIG. 3, the same elements are denoted by the same reference numerals, and description thereof is omitted.

As illustrated in FIG. 4, the addressing compensation circuit 50' according to the embodiment of the present invention stores the displacement current generated during the sustain period for use during a next address period (i.e., the next addressing period). In the addressing compensation circuit 50', the voltage charged in the capacitor C' in the Nth sustain period T3 corresponding to the displacement current Ig3' should be smaller than the address voltage Va charged in the (N+1)th address period T2'. Therefore, the Zener diode Dz is coupled between the switch SW' and the capacitor C' in parallel so that displacement current Ig4 that corresponds to a voltage higher than the address voltage Va flows out through a fourth path ④. Therefore, the value of the Zener diode Dz is selected to clamp the voltage across the capacitor C' at the address voltage Va.

That is, the capacitor C' and the Zener diode Dz for limiting a voltage are additionally provided in parallel to prevent a voltage at an output of the address compensation circuit 50' from increasing to more than an address driving voltage Va, so as to prevent the TCP IC from being burnt out.

According to the exemplary embodiments of the present invention, the address voltage Va is supplied using the displacement current generated by the sustain electrode and the scan electrode to reduce the power consumption of the PDP. In addition, the recovery circuit of the displacement current is additionally provided to prevent heat generation in the SMPS and to prevent the TCP from being burnt out.

Although exemplary embodiments of the present invention have been shown and described, those skilled in the art would understand that changes might be made to these embodiments without departing from the principles and spirit of the invention, the scope of which is defined in the claims and their equivalents.

What is claimed is:

1. A plasma display device (PDP) driven during an address period and a sustain period, the plasma display device comprising:

a discharge cell defined by a scan electrode, a sustain electrode, and an address electrode;

an addressing circuit for providing an address voltage to the address electrode; and an addressing compensation circuit for storing voltage corresponding to a displacement current generated during the sustain period to be utilized during the address period, the addressing compensation circuit comprising:

a switch coupled with the address electrode through which the displacement current generated at the discharge cell during the sustain period is received;

a capacitor coupled with the switch for storing the voltage corresponding to the displacement current received through the switch; and a Zener diode coupled to the switch and the capacitor.

2. The PDP as claimed in claim 1, wherein the Zener diode is coupled with the capacitor in parallel.

3. The PDP as claimed in claim 1, wherein the addressing circuit further comprises a first voltage switch for supplying the address voltage to the address electrode; and a second voltage switch for supplying a voltage lower than the address voltage to the address electrode.

4. The plasma display device as claimed in claim 1, wherein the address electrode forms a second capacitor together with the scan electrode or the sustain electrode to store voltage received from the addressing circuit.

5. A method of driving a plasma display panel in accordance with a driving waveform during a reset period, an address period, and a sustain period, the method comprising:

storing a voltage corresponding to a displacement current generated during a sustain period in a capacitor;

utilizing the voltage corresponding to the displacement current to provide an address voltage during an address period; and storing the address voltage in a second capacitor in accordance with the driving waveform.

6. The method as claimed in claim 5, wherein the stored voltage corresponding to the displacement current is clamped to be no greater than the address voltage.

7. The method as claimed in claim 5, further comprising storing a voltage lower than the address voltage in a second capacitor in accordance with the driving waveform.

* * * * *